United States Patent [19]

McKinley

[11] 4,125,941

[45] Nov. 21, 1978

[54] CAN OPENER ADAPTER FOR BEVERAGE CANS

[76] Inventor: Richard V. McKinley, 1168 S. Gilpin, Denver, Colo. 80210

[21] Appl. No.: 778,130

[22] Filed: Mar. 16, 1977

[51] Int. Cl.[2] ..... B67B 7/30

[52] U.S. Cl. ..... 30/427

[58] Field of Search ..... 30/416–427, 30/433, 434, 436

[56] References Cited

U.S. PATENT DOCUMENTS

| | | | |
|---|---|---|---|
| 970,331 | 9/1910 | Hill | 30/436 |
| 2,429,885 | 10/1947 | Lewis | 30/422 X |
| 2,556,766 | 6/1951 | Mathieu | 30/418 |
| 3,129,509 | 4/1964 | McLean | 30/427 X |
| 3,302,283 | 2/1967 | Carter | 30/422 X |

*Primary Examiner*—Gary L. Smith

*Attorney, Agent, or Firm*—Sheridan, Ross, Fields & McIntosh

[57] ABSTRACT

An adapter is provided for the conventional can opener which allows the can opener to be used for removing the top of a common aluminum type beverage can. A circular ring sized to slidably fit the outside of a beverage can is held in position by a support member which includes a mounting flange which can be secured to an outward extending flange of a can opener. A clamp or other suitable fastener may be used for attaching the adapter to the can opener. The support member holds the can positioning ring so that the bottom portion of the can is tilted outward and slightly forward from the can opener cutting mechanism. The rotation of the cutting wheel is reversed from normal so that the forward portion of the can is drawn into the cutting edge to permit the can top to be severed and the remaining edge rolled under. The adapter allows the opened beverage can to be used as a beverage glass, a baking pan, or a container for potted plants.

6 Claims, 5 Drawing Figures

CAN OPENER ADAPTER FOR BEVERAGE CANS

BACKGROUND OF THE INVENTION

The present invention is directed to an adapter for attachment to a can opener. It is more specifically directed to an adapter for manual can openers for severing the top of a beverage can.

The advent of the aluminum type beverage can has presented various problems to the user. Although the metal of this type can is beneficial in quickly chilling the contents of the container with its inherent reduction in weight, the use of the thinner gauge aluminum presents several problems which heretofore have not been encountered.

As is well known, the common ordinary steel beverage can is straight sided and has a rolled edge sealing the top of the can to the side. This can is constructed much the same as any ordinary can and the use of the present can openers to remove the top of the can is easily accomplished. The material used in the construction of the can is substantially heavier than what is now commonly used in the aluminum type beverage can. With the advent of the aluminum can, major structural problems occur which prevents the ordinary can opener from being used efficiently in opening this type of can.

As is readily known, the body of the aluminum type can is formed from a single piece of metal by an expanding and forming process. Once the can is filled, the top is attached by the usual rolling process which folds and rolls under the edges of the side and top forming a rim which seals the contents. The top edge of the body is indented in this process forming a recessed ring around the top edge immediately below the rim.

The attempt to remove the top of this can with the ordinary can opener proves to be futile in that the cutting wheel either fails to cut the top or cuts both the top and side of the can. At other times the feed wheel, immediately below the cutting wheel, either gouges or tears the thin material of which the side is formed.

It is an object of the present invention to provide an adapter for a can opener which will allow the top of the aluminium type beverage can to be easily and quickly removed without leaving a sharp lip which can injure or cut a user.

It is a further object of the present invention to provide an adapter which can be easily attached to an existing can opener which will hold a beverage container in the proper position to allow it to be opened.

A still further object of the present invention is to provide an inexpensive and easily manufactured adapter for opening beverage cans which can be mounted and attached to any common type can opener.

A further object of the present invention is to provide a modified can opener which is capable of severing the top from the aluminum type beverage container without damaging the side so that the container may be reused for various purposes.

SUMMARY OF THE INVENTION

An adapter or attachment is provided for any existing can opener which can be easily and quickly attached to the frame or flange of the opener. The adapter includes a circular ring sized to fit the outside diameter of the can. The ring is held in proper angular position by an attached support arm having the free end arranged to include a bracket or clamp fastener for conection to the can opener. The angular shape of the support arm and attaching bracket is designed to hold the ring in a particular position so that the can during the opening operation is positioned with the bottom inclined outwardly from the plane of the cutting edge and slightly forward of the axis of rotation of the cutting wheel. The cutting wheel is rotated so that the forward or leading edge of the can is fed into the cutting edge so that the cutting wheel will severe the top and fold the remaining edge under the rim to prevent an exposed sharp edge.

Any type of bracket or attachment can be used to mount the support arm of the adapter to a convenient portion of the can opener near or adjacent to the cutting implement.

The support arm as shown and described in the present embodiment includes two parallel rods which properly angularly position the holding ring for the cutting operation. This arrangement has been found to be economical as well as providing the necessary rigidity.

The adapter as described herein can be fabricated from any material desired such as steel, aluminum, brass, or molded from plastics or synthetic resins or the like. It is desirable that a universal type mounting arrangement be provided for attaching the adapter to any type of existing can opener.

BRIEF DESCRIPTION OF THE DRAWINGS

Other objects of this invention will appear in the following description and appended claims, reference being made to the accompanying drawings forming a part of the specification where like reference characters designate corresponding parts in the several view.

DETAILED DESCRIPTION OF THE EMBODIMENTS

Figure 1:
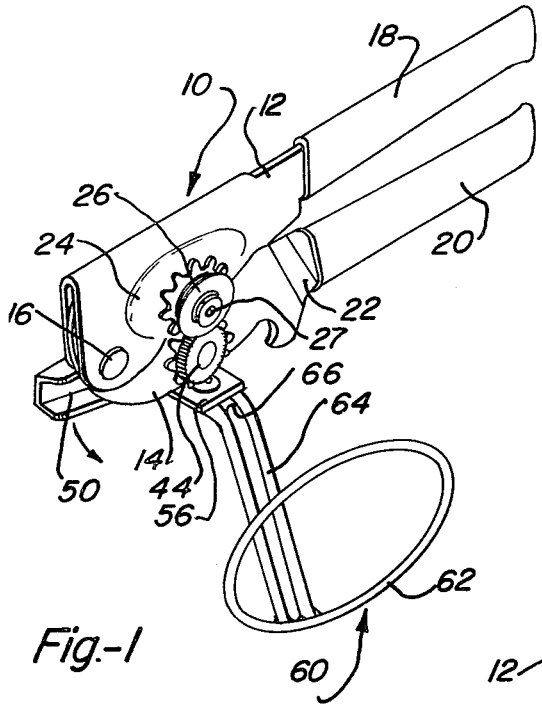
FIG. 1 is a perspective view of a can opener with the beverage type can positioning adapter according to the present invention mounted thereon.

Turning now more specifically to FIG. 1, a common type manual can opener 10 is shown having an upper section or element 12 and lower section or element 14. The sections 12 and 14 are pivotally attached at their forward ends by stud 16.

Handles 18,20, respectively, are provided on the upper and lower elements 12,14. These handles can be covered with suitable material such as plastic to facilitate comfort and ease of handling by the user. Lower section 14 of the can opener 10 is offset in the area 22 immediately in front of the handle 20 to allow the sections to abut so that the handles 18,20 can be held in proper alignment and position by one hand.

A bulge or bubble 24 is provided in the side of the upper element 12 for rotatably mounting a cutting wheel 26 on shaft 27. The cutting wheel has an outer cutting perimeter having a V shaped cross section forming a cutting edge 28. Spaced inwardly from the cutting edge 28 is a body spacer 30. A drive gear 32 is mounted on the shaft 27 with an outwardly biasing spring 34 included to properly position the wheel 26 against the restainer nut 36. The gear 32 and cutting wheel 26 are drivingly connected to each other or are formed as one piece to prevent slippage.

Mounted to the lower element 14 of the can opener 10 is a rotating member 40 having a shaft 42 which is rotatably mounted in the element 14. At one end positioned in conjunction with the cutting wheel 26, is a feed wheel 44 having a scored perimeter surface 46. Offset inwardly from the wheel 44 is a gear 48 which conveniently meshes with the cutting wheel drive gear 32, when the elements 12 and 14 are held together in the operating position. A handle 50 is attached to the end of the shaft 42 by means of a nut 52.

The shaft 27 is inclined at an angle of approximately 30° from the axis of the rotating number 40 so that the cutting edge 28 is properly spaced and positioned with an overlapping arrangement with respect to the face of the feed wheel 44. A flange 56, arranged at right angles with the member 14, is positioned directly below the feed and cutting wheels. Normally the edge of this flange 56 contacts the side of the can and prevents it from coming in contact with the outer surface of the feed wheel 44.

The beverage can opening adapter or attachment 60 as provided in the present invention is shown in FIG. 1. The adapter 60 includes a circular ring 62, support arm 64, and mounting or attaching flange 66. Any type of device, as desired, can be used for attaching the adapter to any convenient portion of the can opener such as the outwardly extending flange 56. As shown in the present embodiment, a bolt 70 and wing nut 72 are provided. It is to be understood, however, that any type of bracket or clamp which will rigidly hold and align the adapter to the can opener can be utilized.

Figure 2:
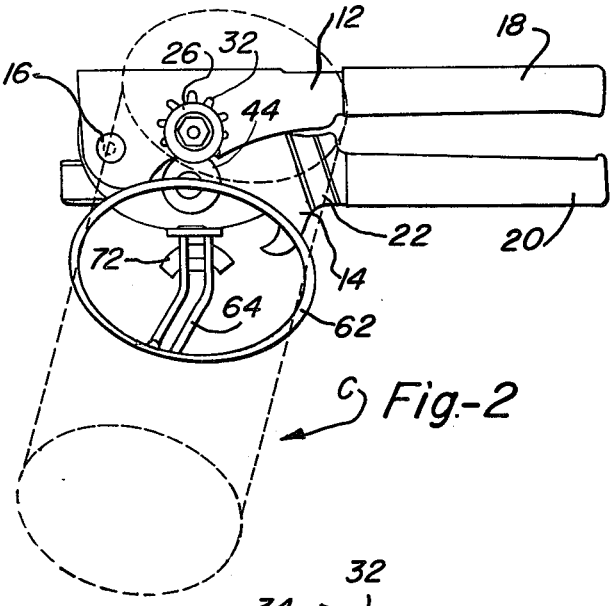
FIG. 2 is a side elevation view of the can opener as shown in FIG. 1, angle and tilt to the positioning ring is slightly exaggerated so that the position of the can with respect to the cutting wheel can be easily seen.
Figure 3:
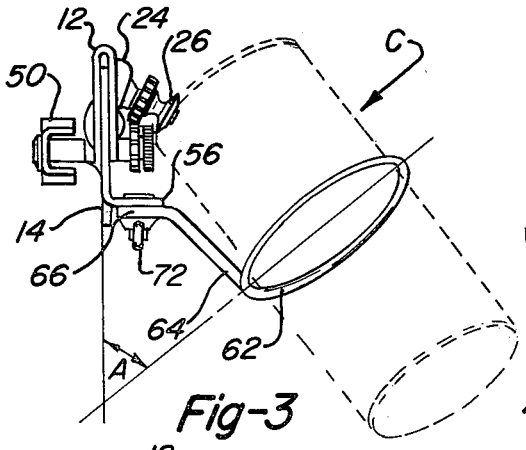
FIG. 3 is a front elevation view of the can opener showing the position of the ring and can with respect to the cutting element.

An important feature of the present invention is the angle at which the positioning ring 62 holds the beverage can C as illustrated in FIGS. 2 and 3 with respect to the cutting wheel 26 and feed wheel 44.

Figure 4:
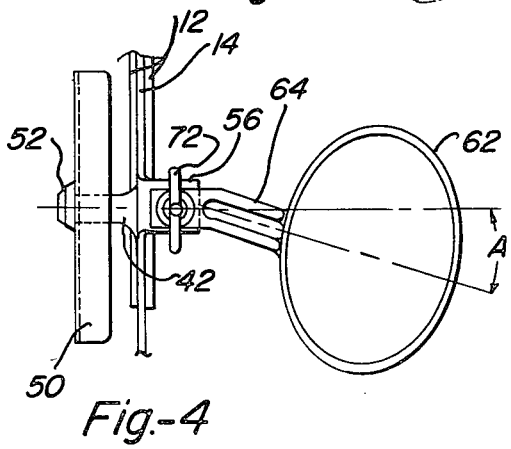
FIG. 4 is a partial bottom view showing the connection of the adapter to the bottom surface of the can opener flange and the forward extending angle of the ring support arm.

As can be seen in FIG. 4, the support arm 64 is bent forward or canted so that the ring is held at an angle within a range of approximately 5° to 15° from a transverse plane through the axis of the cutting wheel as represented by the angle A. In FIG. 3, the ring is shown tilted outwardly from the plane of the section 12,14 at an angle within the range of 45° to 60° as represented by the angle B. These angles properly position the can with respect to the cutting wheel 26 to obtain the necessary relief and clearances for proper operation.

Figure 5:
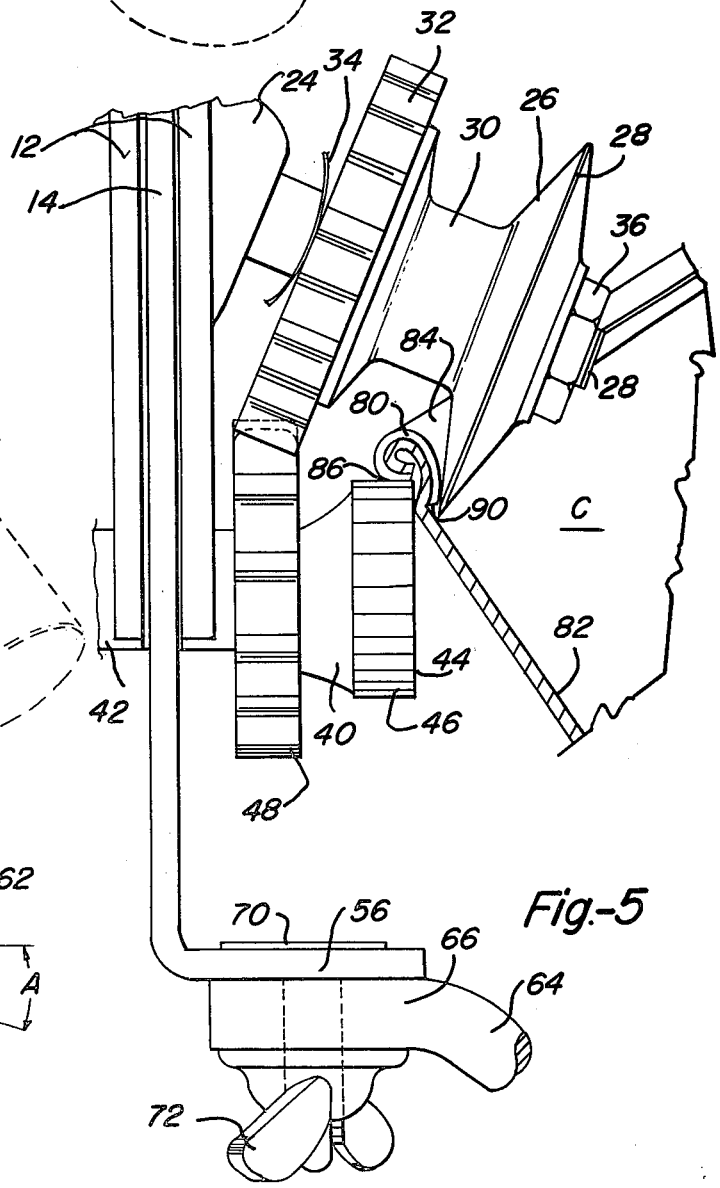
FIG. 5 is a partial enlarged view showing the cutting and feeding elements of the common can opener with respect to the can top during the opening of a beverage type container.

In FIG. 5 is shown a cross section of a typical can C during an opening process. The rim 80 is formed by rolling the edges of the side 82 and top cover 84 together in a rolling operation. The under surface 86 of the rim 80 rides on the scored surface 46 of the feed wheel 44. With the can properly positioned by the adapter ring 62, the cutting edge 28 of the cutting wheel 26 is properly positioned for a depth of cut through only the top cover portion 84 of the can C. With the handle 50 rotated in counter clock wise rotation as seen in FIG. 1, the feed wheel 44 draws the rim 80 into the cutting wheel 26 with a relief angle between the rim and wheel caused by the forward angle position A. This relief angle allows proper feeding of the rim into the cutting edge 28 to allow the severed edge 90 of the top cover 84 to be bent under to prevent the exposure of the sharp edge.

In this way, once the top of the can has been removed by means of the can opener utilizing the present adapter, safe use of the can for whatever purpose desired can be obtained.

An attachment for a can opener for use in opening aluminum type beverage cans has been shown and described in detail, it is to be understood that this invention is not to be limited to the exact form disclosed in that changes and details in construction may be made therein within the scope of the invention without departing from the spirit thereof.

What is claimed is:

1. The combination of a can opener and a guide means mounted on said can opener, the can opener having a cutting means and a feeding means drivingly connected, said feeding means having a drive means for rotating the feeding means whereby the top rim of a can can be moved into the cutting means so that the top can be severed and removed, the guide means being arranged to properly position the can with respect to the cutting and feeding means, wherein the improvement in said guide means is an attachment which allows removal of the tops of beverage-type cans, the attachment comprises a. position means sized to generally fit the outside diameter of a beverage-type can, b. support means having one end fixedly attached to said position means, c. removable mounting means at the opposite end of said support means from said position means, said mounting means being removably mounted on a portion of said can opener whereby said position means is held rigidly with respect to said cutting and feeding means, said position means being positioned in proper location to hold and guide the beverage can during the removal of the top so that the severed edge of said can is crimped to prevent a user from being injured by the edge, d. said position means when the attachment is mounted on said can opener being tilted to form an angle with a plane through the body of said can opener so that the longitudinal axis of a can is tilted with the bottom portion inclined outwardly from the plane through said body, and e. said position means is also arranged to form an angle with a transverse plane through the cutting and feeding means, said transverse plane being normal to the can opener plane, said position means being arranged so that the longitudinal axis of the can is also positioned with the bottom portion positioned to one side of the transverse plane so that a relief angle is provided as the can top is moved into said cutting means.

2. A combination as defined in claim 1 wherein the angle of tilt of the position means is within the range of 45° to 60°.

3. A combination as defined in claim 1 wherein the angle of the position means with respect to the transverse plane is within the range of 5° to 15°.

4. A combination as defined in claim 1 wherein said positioning means is at least a portion of a ring and said support means is an outwardly extending arm which properly positions and spaces the ring with respect to the cutting means of said can opener.

5. A combination as defined in claim 1 wherein said mounting means includes a flange having a planar surface arranged to fit against a suitable surface of said can opener, said flange and opener surfaces being held together by a fastening means whereby said attachment is removable and said positioning means is held in proper position during the cutting operation.

6. A combination as defined in claim 1 wherein said positioning means is a closed, circular ring, said ring having a diameter which is slightly larger than the outside diameter of the beverage can so that the can is free to rotate within said ring but is held in proper position during the cutting operation.

* * * * *